US005641169A

United States Patent [19]

Bekessy

[11] Patent Number: 5,641,169

[45] Date of Patent: Jun. 24, 1997

[54] QUICK RELEASE ICE SKATE BLADE ASSEMBLY

[76] Inventor: George J. Bekessy, 397 Timberlane, Post Falls, Id. 83854

[21] Appl. No.: 327,297

[22] Filed: Oct. 21, 1994

[51] Int. Cl.[6] ..... A63C 1/30

[52] U.S. Cl. ..... 280/11.18; 280/11.12

[58] Field of Search ..... 280/11.18, 11.16, 280/841, 7.13, 7.14, 11.22, 11.12, 11.3, 11.33, 11.34, 11.31, 28

[56] References Cited

U.S. PATENT DOCUMENTS

| | | | |
|---|---|---|---|
| 23,344 | 3/1859 | Behr | 280/11.33 |
| 480,051 | 8/1892 | Warner | 280/11.33 |
| 945,795 | 1/1910 | Neuberth | 280/11.16 |
| 1,608,963 | 11/1926 | Smilden | 280/11.18 |
| 1,702,695 | 2/1929 | Hoult . | |
| 2,108,128 | 2/1938 | Kinney | 280/11.18 |
| 2,150,964 | 3/1939 | Dornseif | 280/11.18 |
| 2,203,278 | 6/1940 | Foley | 280/11.12 |
| 2,868,553 | 1/1959 | Rieckman . | |
| 3,026,118 | 3/1962 | Pare | 280/11.3 |
| 3,367,669 | 2/1968 | Collins | 280/11.3 |
| 3,918,729 | 11/1975 | Peters | 280/11.3 |
| 4,008,901 | 2/1977 | Conn | 280/7.13 |
| 4,114,295 | 9/1978 | Schaefer | 36/100 |
| 4,218,069 | 8/1980 | Baikie | 280/11.18 |
| 4,328,627 | 5/1982 | Sanders | 36/115 |
| 4,379,563 | 4/1983 | Arsenault | 280/7.1 |
| 4,657,265 | 4/1987 | Ruth | 280/7.13 |
| 4,666,168 | 5/1987 | Hamill et al. | 280/11.2 |
| 4,666,169 | 5/1987 | Hamill et al. | 280/11.23 |
| 4,907,813 | 3/1990 | Hall | 280/11.18 |
| 4,932,675 | 6/1990 | Olson et al. | 280/7.13 |
| 4,988,122 | 1/1991 | Saunders | 280/841 |
| 5,046,746 | 9/1991 | Gierveld | 280/11.22 |
| 5,088,749 | 2/1992 | Olivieri | 280/11.18 |
| 5,123,664 | 6/1992 | DeMars | 280/11.18 |
| 5,199,726 | 4/1993 | Willett | 280/11.27 |
| 5,295,701 | 3/1994 | Reiber et al. | 280/11.22 |
| 5,320,366 | 6/1994 | Shing | 280/7.14 |
| 5,331,242 | 7/1994 | Cann et al. | 280/11.18 |
| 5,484,148 | 1/1996 | Olivieri | 280/11.18 |

FOREIGN PATENT DOCUMENTS

| | | | |
|---|---|---|---|
| 0060348 | 12/1891 | Germany | 280/11.31 |

*Primary Examiner*—Anne Marie Boehler

[57] ABSTRACT

A quick release ice skate blade assembly is described for attachment to an ice skate boot. The assembly includes an elongated skate frame that provides a longitudinal blade receiving recess formed by laterally spaced flanges extending downwardly from a frame bearing surface. An elongated skate blade is receivable within the recess. It includes a longitudinal lower runner edge and an upper blade bearing surface with upwardly open, transverse recesses formed therein to facilitate mounting to the blade frame. A pair of lifts are mounted within the skate frame at longitudinally spaced locations, releasably interconnecting the blade by the recesses therein to skate frame. The lifts are rotatable about substantially parallel axes to raise and lowering the blade elevationally between (a) a downward position where the upper blade bearing surface is spaced downwardly from the frame bearing surface with the skate blade being releasable from the skate frame, and (b) an upward position with the upper blade bearing surface received between the flanges and in bearing engagement with the frame bearing surface. A pair of locks are also provided on the skate frame for releasably securing the lifts to lock the blade in the upward position.

8 Claims, 5 Drawing Sheets

10
11
13
15
17
20
20
21
25
25
40
40
41
41
50
50
53
54
55
57
58
5
5

QUICK RELEASE ICE SKATE BLADE ASSEMBLY

TECHNICAL FIELD

The present invention relates to quick changing of ice skate blades and blades facilitating quick change procedures.

BACKGROUND OF THE INVENTION

Ice skate blades are typically fixed rigidly to ice skate boots. This arrangement serves an important purpose since the blades must remain stationary relative to the skater's feet. However the blades quickly dull and require sharpening. Dull blades seriously impair a skaters performance and can become a safety hazard. Skating enthusiasts and professionals thus require at least one pair of sharp skates per performance. Since ice skates are expensive, owning several pairs is burdensome.

As a solution of the above problem, quick change blades have been proposed to enable a skater to use one set of boots and several sets of skate blades. Various mounting mechanisms have been developed to enable changing from one set of blades to another. These mechanisms and interchangeable blades have not been satisfactory for several reasons.

Firstly, interchange mechanisms have typically been designed to latch the blades to skate frames by providing gripping or latching actions that operate to exert holding forces on the blades in longitudinal directions (with respect to the lengths of the blades). They release by application of opposite longitudinal forces being applied to the latching or gripping devices. Such longitudinal forces can, in certain circumstances be applied through the skate blades, as when the skates strike an object. The consequence can be undesired and unpredictable release or loosening of the blades in the skate frames, often during use.

Other interchangeable mechanisms are quite cumbersome and difficult, making "quick changing" an unrealistic goal.

Still other interchangeable mechanisms require attachments on the skate blades themselves that are bulky and interfere with sharpening equipment and procedures.

An object of the present invention is therefor to provide a quick change blade mechanism that will not release by application of longitudinal forces being applied to the skate blade.

Another object is to provide such a quick change blade mechanism that facilitates quick and easy interchange of blades.

A further object is to provide a quick change blade that is unencumbered with latching or fastening mechanisms and that can be easily produced and that can further be easily secured for sharpening.

These and further objects and advantages will be understood from the following description which, taken with the accompanying drawings, describe a presently preferred mode of carrying out the present invention.

BRIEF DESCRIPTION OF THE DRAWINGS

Preferred embodiments of the invention are described below with reference to the accompanying drawings, which are briefly described below.

FIG. 3 is a sectional view through the assembly, taken along line 3—3 in FIG. 2;

FIG. 4 is a view similar to FIG. 3 only showing the present lift and blade in a downward position;

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Figure 1:
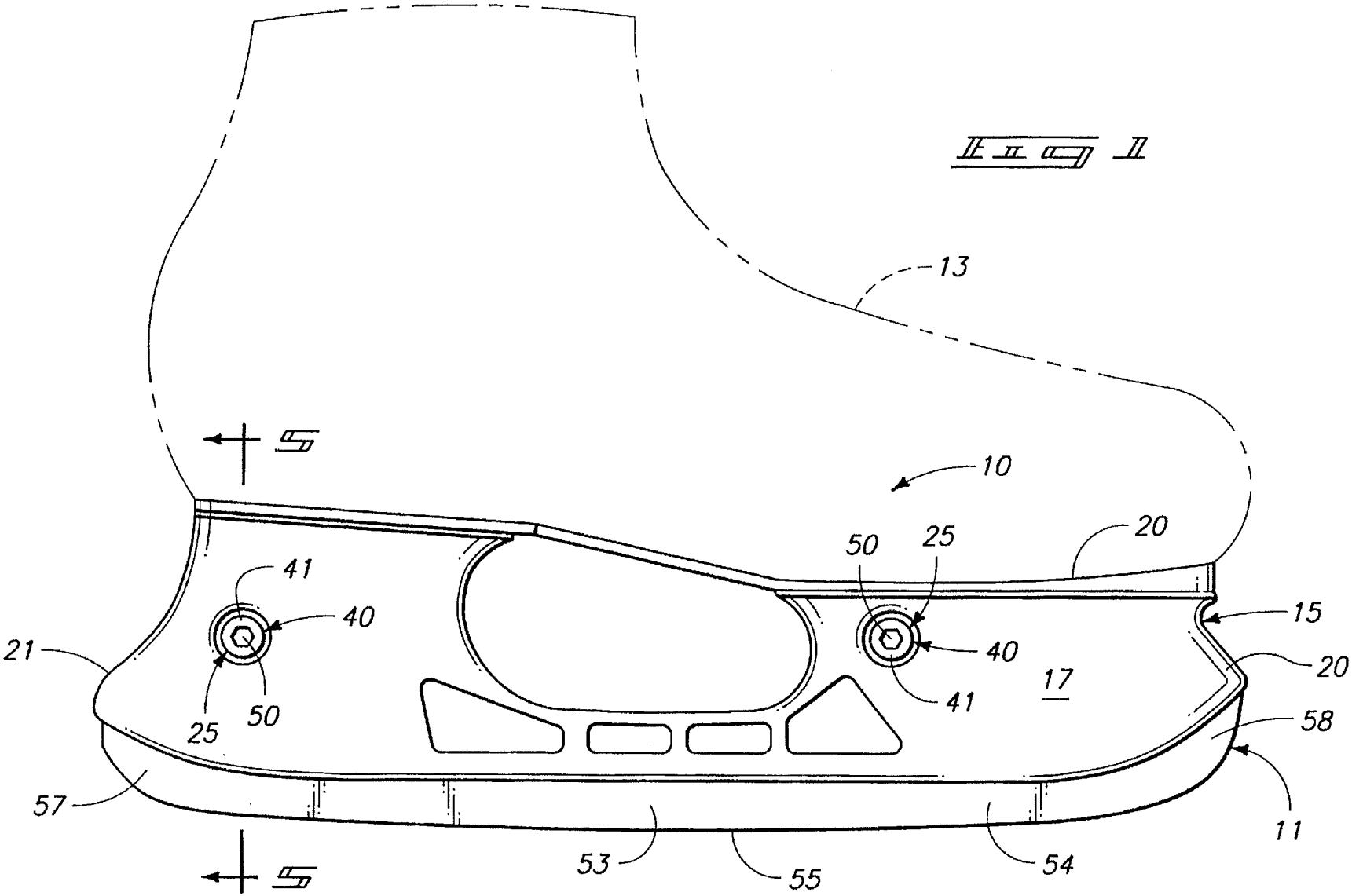
FIG. 1 is a side elevation view of an assembled quick change ice skate blade assembly of a first preferred form, with a skate boot shown in phantom lines.

FIG. 1 illustrates a preferred example of the present quick change ice skate blade assembly, as generally designated by the reference numeral 10 with a skate blade 11 mounted by a skate frame 15 to a skate boot 13.

It is pointed out that the boot 13 is shown in phantom lines simply to show the environment and location of the boot relative to the present assembly 10. The boot may take any desired form, including various hockey type boots or figure skate boots.

The present assembly 10 is mountable to the various boot soles using any of various conventional mounting technologies, including riveting, screws, bolts, adhesives, etc.

It is also conceivable that the present elongated skate frame 15 be formed integrally with the boot, as by various molding or forming procedures. However it is most preferred at the present time that the frame 15 be produced separately from the boot, to be attached thereto by processes similar to those known to ice skate manufacturers.

The elongated skate frame 15 is advantageously formed as a single, injection molded unit. It may be formed of fiber impregnated carbon resin, "Lexan", "Nylon", or another appropriate material that is tough, impact resistant, water resistant, and somewhat resilient under compression.

Figure 2:
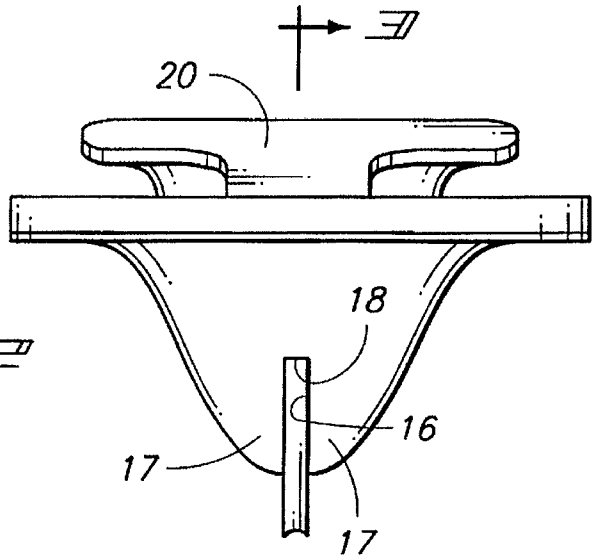
FIG. 2 is an end view of the preferred assembly.
Figure 1:
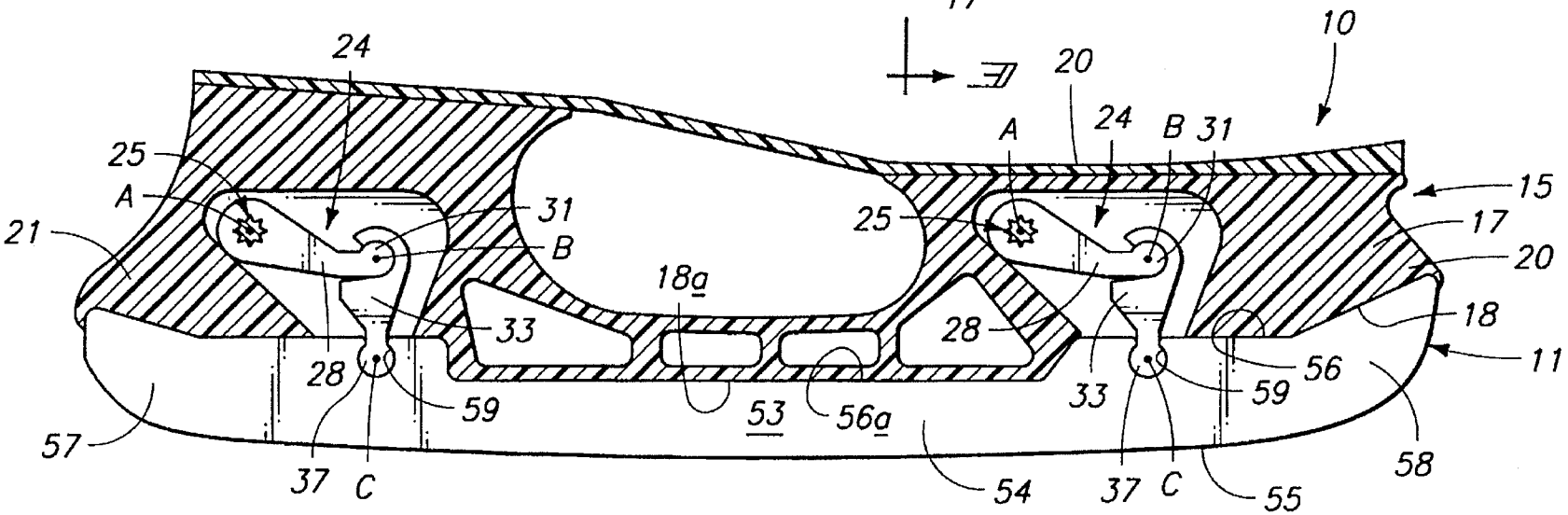
Figure 2:
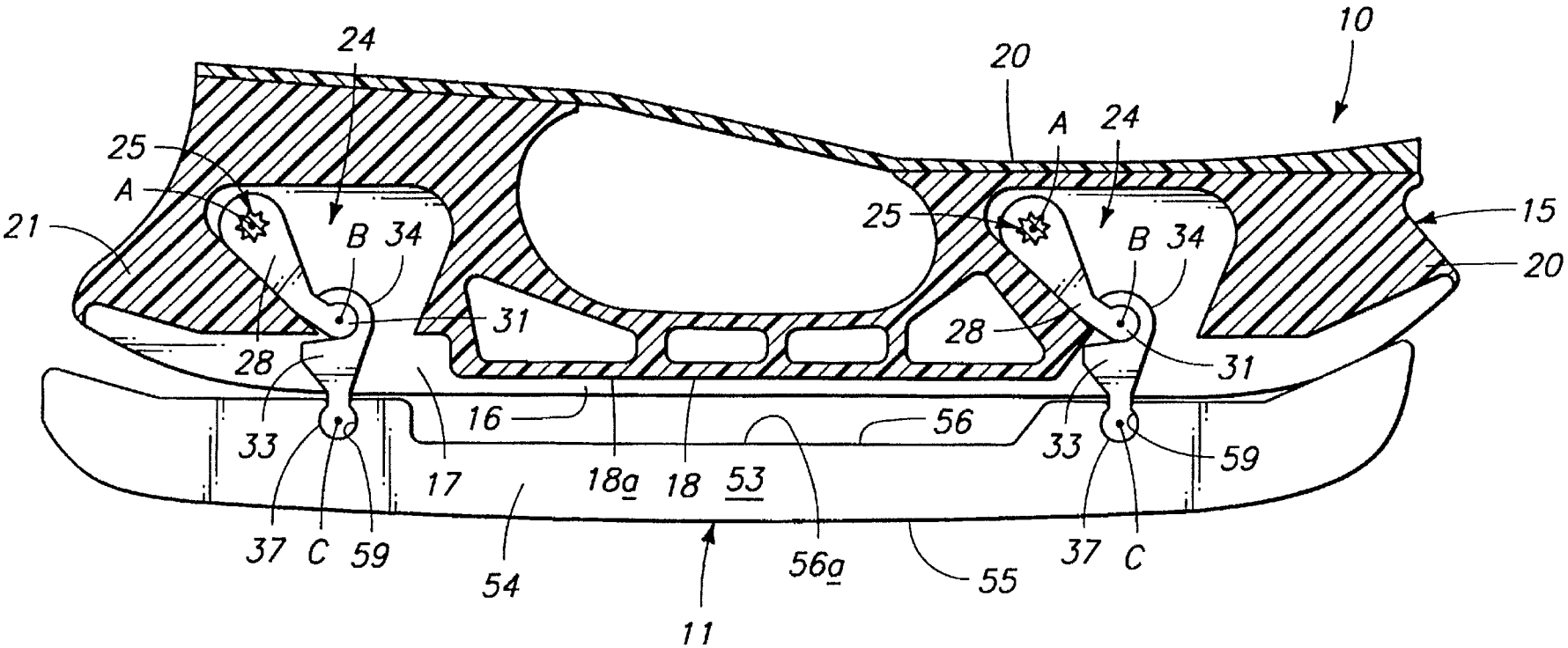

The skate frame includes a downwardly projecting longitudinal blade receiving recess 16 (FIG. 2) that is defined between downwardly extending transversely spaced flanges 17. The flanges 17 are located on opposite sides of an elongated frame bearing surface 18 that extends the length of the frame from its toe end 20 to its heel end 21.

Figure 5:
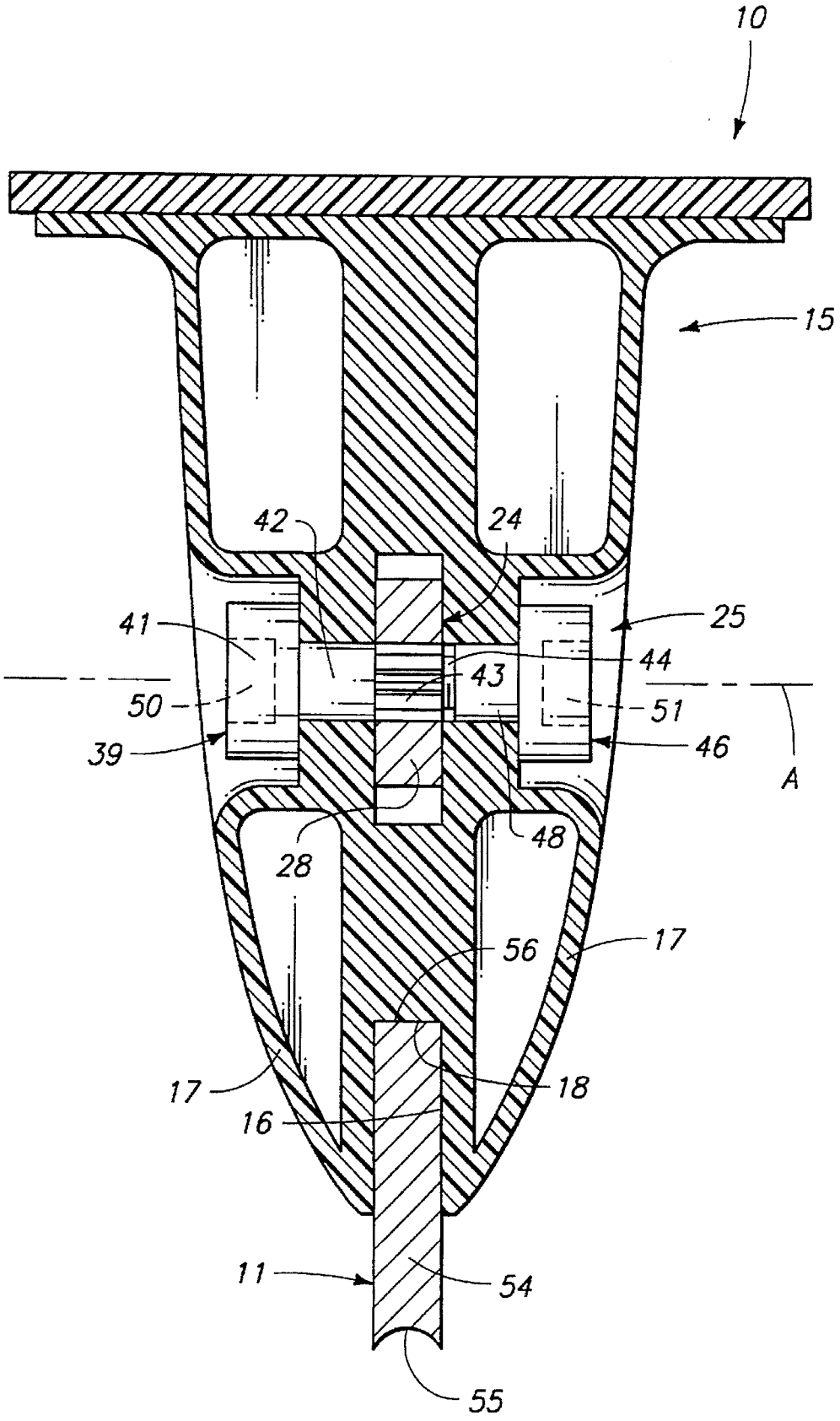
FIG. 5 is a sectional view through the assembly, taken along line 5—5 in FIG. 1.

The bearing surface 18 is shaped to mate flush with a complimentary surface of the blade 11. Further, the flanges 17 are spaced apart by a distance substantially equal to the blade thickness. At least approximately half of the overall blade height (FIG. 5) is thus receivable in flush abutment within the blade receiving recess 16, against the inner surfaces of the flanges 17 and against the frame bearing surface 18.

The top surface of the skate frame 15 includes a sole mounting surface 20 that may be configured to conform to a desired boot sole construction. The surface 20 may also be mounted to an intermediate plate or other structure to be situated between the boot 13 and skate frame 15.

In a preferred form at least one and more preferably a pair of lifts 24 are provided within the skate frame 15. The lifts 24 are provided for releasably interconnecting the blade 11 and skate frame 15 for raising and lowering the blade 11 elevationally. The blade will thus be selectively movable between (a) a downward position (FIG. 4) wherein an upper bearing surface of the blade (described below) is spaced downwardly from the frame bearing surface 18 with the skate blade 11 being releasable from the skate frame, and (b) a upward position (FIGS. 1, 3) with the upper blade bearing surface received between the flanges 17 and in bearing engagement with the frame bearing surface 18.

In a preferred form, the lifts 24 are substantially identical, spaced apart longitudinally along the skate frame 15 inwardly of the toe and heel ends 20, 21. Since the lifts 24 are substantially identical, description of one lift 24 will serve as description of the other.

Locks 25 are also provided for each lift 24. The locks 25 serve to selectively releasably secure the associated lift 24 in the upward position. The locks 25 are also substantially identical so description of one lock 25 will serve as description for the other.

Referring in detail to the lift 24, reference is made to the sectional views and perspective views of FIGS. 2–6. There each lift 24 is shown as including an elongated lever 28 pivotably mounted to the skate frame 15 for movement about a first axis A that is transverse to the longitudinal blade receiving recess 16.

Figure 6:
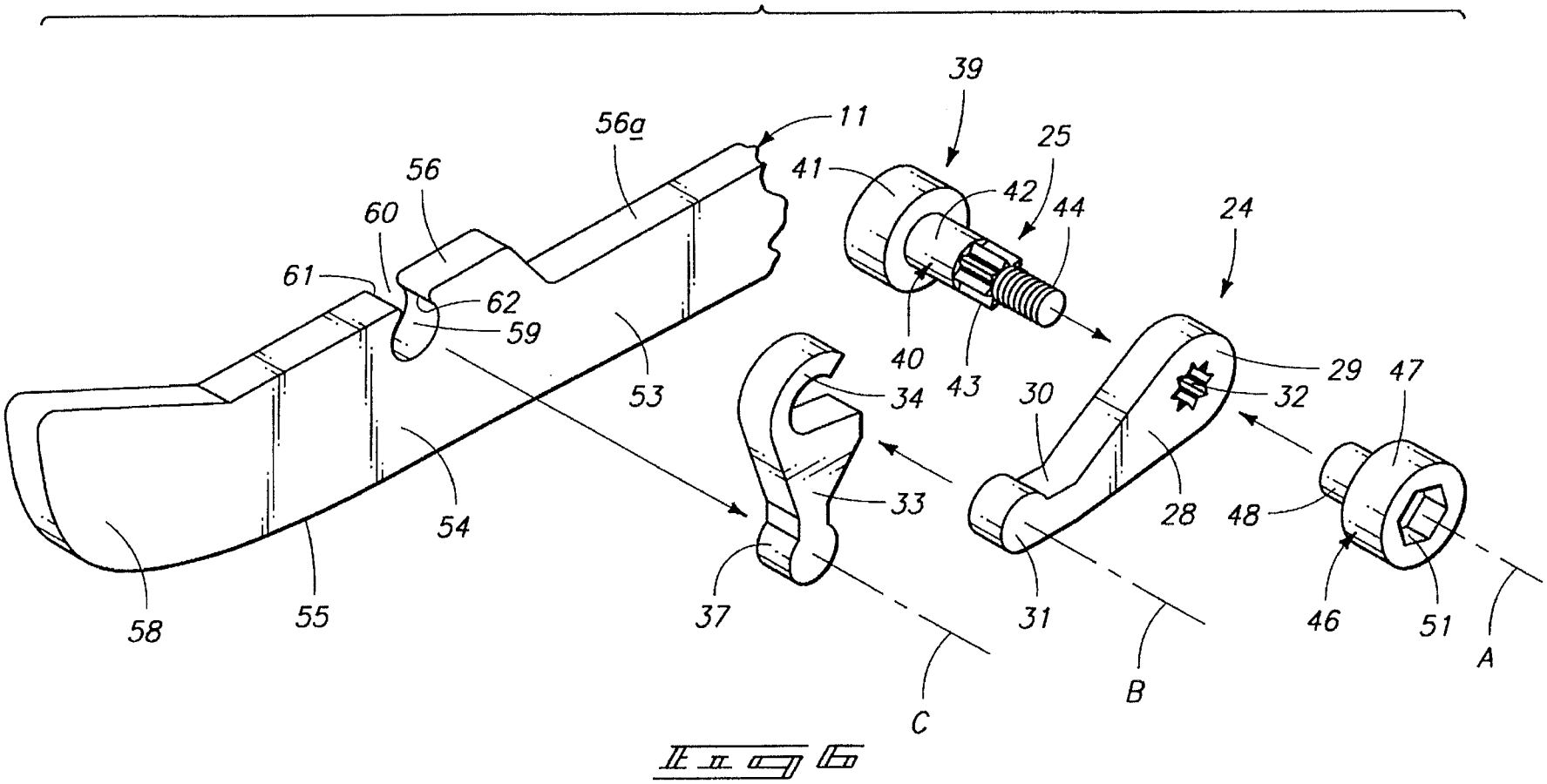
FIG. 6 is a fragmented perspective exploded view of the lift and skate blade of the present preferred form.

The lever 28 extends forwardly from one end 29 to an other end 30. A circular joint member 31 is provided at the one end 29, and the other end includes a spline hole 32 (FIG. 6).

A link 33 is pivotably suspended from the lever 28. Link 33 includes an upper end 34 that is cupped to pivotably receive the joint member 31. The link 33 will pivot on the lever 28 about a second axis B that is substantially parallel to the axis A. A ball 37 is provided at a lower end 36 of the link 33. The ball 37 is releasably receivable within a complimentary recess (described below) formed in the blade 11.

The lock 25, in a preferred form, includes a pivot bolt clamp assembly 39. Lock 25 is positioned on the skate frame 15 to clamp the frame 15 against the elongated lever 28, and thereby lock the lift against pivotal movement.

The preferred pivot bolt clamp assembly 39 includes a bolt 40 (FIG. 6) having an integral headed end 41, a shank 42, and a threaded end 44. A spline surface 43 is provided on the shank 42 to be received within the spline hole 32 of the lever 28.

The bolt 40 is rotatably received transversely through the skate frame 15 coaxially with the first axis A. The headed end rotatably abuts the skate frame 15 and is exposed outwardly as shown in FIG. 1. The shank 42 extends into the skate frame 15 where the spline surface 43 mounts the lever 28 within an appropriately formed pocket within the frame.

The pivot bolt clamp assembly 39 also includes a nut 46, threadably engaged on the threaded bolt end 44. The nut 46 is preferably a form of cap nut, including a head 47 and a threaded socket 48. The socket 48 rotatably extends through the skate frame 15 to threadably receive the threaded bolt end 44. The head 47 rotatably engages the skate frame opposite the bolt head 41. Head 47, like bolt head 41 is exposed outwardly of the skate frame 15.

The bolt head 41 and nut head 47 include tool access surfaces 50, 51 respectively (FIGS. 1, 6) for engagement by tools to permit manual rotation of the nut 46 and headed bolt 40 to (a) adjust clamping forces exerted against the skate frame 15 and lift 24, and (b) permit selective rotation of the bolt 40 to pivot the lift 24 about the first axis A.

To adjust clamping forces exerted against the skate frame 15, the nut 46 and socket 48 are rotated on the threaded end 44 of the bolt 40 to decrease the transverse distance between the nut and the bolt heads 41, 47. This serves to compress the skate frame 15 between the heads 41 and 47 and clamp the lever securely in position, locking the lift. Loosening of the nut 46 releases the clamping force and permits the lever to rotate about the first axis A. The lift 24 may then be pivoted about the first axis A by rotating the bolt 40 to likewise rotate the lever 28 about the first axis A.

The skate blade 11 is preferably formed of a rigid metal, conventionally known in ice skate technology. However, the present blade 11 is specially formed for use in the present assembly 10. To this end, the skate blade 11 includes a rigid body 54 including a longitudinal lower runner edge 55 and an upper blade bearing surface 56 extending between heel and toe ends 57, 58 respectively.

The upper blade bearing surface 56 is formed with a central depression area **56*a* to longitudinally interlock or dovetail with a complimentary downwardly projecting area 18*a* of the frame bearing surface 18, coming into flush abutment with the complimentary shaped surface 18 when elevated to the upward position as shown in FIG. 3**.

Planar sides 53 of the blade body 54 are preferably substantially parallel and spaced apart transversely to define the thickness of the blade. The thickness dimension is substantially equal to the width of the blade receiving recess 16 of the blade frame 15. Thus when the blade is in the upward position, the sides 53 and blade bearing surface 56 are in flush engagement against respective inside faces of the flanges 17 and frame bearing surface 18. The blade 11 is thus rigidly braced and held securely by the frame 15.

The blade 11 further includes at least one and most preferably a pair of recesses in the form of substantially circular openings 59 (FIG. 6). The openings 59 are formed at least partially transversely through the skate blade body 54 downwardly adjacent the upper blade bearing surface 56. They are situated longitudinally between the heel and toe ends 57, 58 to pivotably receive the balls 37 at the lower link ends 36. The balls 37 pivot within the openings 59 about a third axis C that is substantially parallel to the first axis A.

An open channel 60 (FIG. 6) is provided for each opening 59, formed at least partially transversely through the skate blade body 54. Each of the channels lead substantially vertically from open top ends 61 at the upper bearing surface 56 to bottom ends 62 that open into the associated circular opening 59.

Each of the channels 60 includes a longitudinal open dimension (FIGS. 3, 4, and 6) that is less than the diameter of the associated substantially circular opening 59. The channels 60 receive portions of the links 33 adjacent the balls 37 and allow pivotal motion of the lower link ends 36 about the third axis C. The narrow channels 60 will not permit elevational movement of the balls 37 relative to the blade 11. The balls 37 are thus captured within the openings 59, but will pivot relatively freely within the openings 59 about the third axes C.

The blade 11 is releasably attached to the lift 24 by laterally moving the blade onto the link balls 37 such that the balls 37 are received within the openings 59. The portions of the links 33 upwardly adjacent the balls 37 are received within the channels 60.

It is again pointed out that there are, in a preferred form, pairs of the lifts 24, locks 25, openings 59 and channels 60 are provided in a preferred form of the present assembly 10. Thus there are pairs of first, second, and third axes A, B, and C, all of which are substantially parallel. The pairs of lifts 24, and locks 25 are aligned along the longitudinal blade receiving recess, while the openings 59 and channels 60 are aligned along the blade 11.

In each pair of lifts 24, the levers 28 extend angularly in the same longitudinal direction when in the upward position (FIG. 3). Thus the first axes A are longitudinally spaced from the second axes B.

In operation, the skater may quickly attach a blade 11 to the skate frames 15 of each skate, using simple tools such as hex head wrenches, sized to be received by the tool receiving surfaces 50, 51. To dismount a blade 11 from a skate frame 15, the user simply uses hex tools to loosen the nuts 46. This is done while holding the respective bolts 40 against rotation. This releases the clamping forces against the lifts 24. The bolts 40 may now be rotated to pivot the levers 28 downwardly. The links 33 and the attached blade 11 are simultaneously lowered to the position shown in FIG. 4.

The blade 11 is now substantially clear of the skate frame 15 and can be easily removed simply by sliding it laterally from engagement with the link balls 37. The blade is now free of the skate and can be replaced by another blade 11.

At a later time, the removed blade 11 may be easily secured, due to its unincumbered flat configuration, to a sharpening device (not shown or part of this application). In fact, the recesses 59 may be readily used for precisely positioning and securing the blade relative to the sharpening device.

To mount a fresh blade, the user simply attaches the blade by sliding the openings 59 laterally onto the exposed link balls 37. Using a hex tool, the user next rotates the bolts 40 to swing the levers 28 upwardly.

The levers 28 lift the links 33 and attached blade 11 upwardly into the blade receiving recess 16 until the upper blade bearing surface 56 comes into flush, firm contact with the blade frame bearing surface 18 of the skate frame 15. Now the levers are held against turning while the locks 25 are actuated by tightening the nuts 46 on the bolt threads 44.

As the nuts 46 are tightened, the nut heads 47 and opposed bolt heads 41 compress the skate frame material against the levers 28, locking them in place. The blade 11 is now mounted and the skate is ready for use.

The entire procedure of removing one blade and replacing it with a fresh blade takes at most only a few moments, and may be accomplished by the skater without assistance. The only tools required are a pair of hex head tools that are easily carried in a pocket.

It is pointed out that the lifts 24, by lifting and elevationally holding the blade 11 in place firmly within the recess 16, will securely hold the blade until the locks 25 are released. During use, the skate blade is primarily loaded vertically by the weight of the skater. Such loading, even if the blade bends or flexes slightly during use, will not tend to loosen the locks 25. In fact, vertical loading will only function to further seat the blade 11 against the frame bearing surface 18.

Lateral loading will not result in lateral movement or loosening of the blade as it is held securely between the flanges 17 and thus cannot become disengaged from the links within the skate frame 15. Longitudinal loading is met with similar resistance to movement or loosening due to the clamping action of skate frame 15 against the levers and the complimentary interlocked mating surfaces configurations **18*a* and 56*a* of the skate frame bearing surface 18 and blade bearing surface 56**.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

I claim:

1. A quick release ice skate blade assembly, comprising:

an elongated skate frame including a longitudinal blade receiving recess formed by laterally spaced flanges extending downwardly from a frame bearing surface;

an elongated skate blade including a longitudinal lower runner edge and an upper blade bearing surface;

a lift mounted within the skate frame releasably interconnecting the blade and skate frame for raising and lowering the blade elevationally between (a) a downward position wherein the upper blade bearing surface is spaced downwardly from the frame bearing surface with the skate blade being releasable from the skate frame, and (b) an upward position with the upper blade bearing surface received between the flanges and in bearing engagement with the frame bearing surface; and wherein the lift is comprised of:

an elongated lever extending between ends with one end being pivotably mounted to the frame for pivotal movement about a first axis transverse to the longitudinal blade receiving recess;

a link pivotably mounted to the other end of the lever and being releasably connected to the skate blade; and a lock on the skate frame releasably securing the lift in the upward position.

2. A quick release ice skate blade assembly, as claimed by claim 1 wherein the lock is comprised of a pivot bolt clamp assembly positioned on the frame to clamp the frame against the lift.

3. A quick release ice skate blade assembly, as claimed by claim 1 wherein the lock is comprised of a pivot bolt clamp assembly mounting the lift to the frame for pivotal motion about a first axis that is transverse to the longitudinal blade receiving recess.

4. A quick release ice skate blade assembly, as claimed by claim 1 wherein the lock is comprised of a pivot bolt clamp assembly including:

a bolt having a headed end and a shank rotatably journalled in the ice skate frame for rotation about a first axis transverse to the longitudinal blade receiving recess, the headed end being in abutment with the ice skate frame and the shank mounting the lift for rotational movement about the first axis and extending to a threaded end; and a nut having a head in abutment with the skate frame laterally opposite the headed end of the bolt, and a threaded socket for threadably receiving the threaded end of the shank, said nut being rotatable against the skate frame selectively to compress the skate frame between the headed end of the bolt and head of the nut and thereby grip the lift and prevent rotation thereof about the first axis.

5. A quick release ice skate blade assembly, as claimed by claim 1 wherein the lock is comprised of a pivot bolt clamp assembly including:

a bolt having a headed end and a shank rotatably journalled in the ice skate frame for rotation about a first axis transverse to the longitudinal blade receiving recess, the headed end being in abutment with the ice skate frame and the shank mounting the lift for rotating the lift about the first axis and extending to a threaded end;

a nut having a head in abutment with the skate frame laterally opposite the headed end of the bolt, and a threaded socket for threadably receiving the threaded end of the shank, said nut being rotatable against the skate frame on the threaded end of the shank to selectively clamp the skate frame between the headed end of the bolt and head of the nut and thereby grip the lift and prevent rotation thereof about the first axis; and wherein the headed end of the bolt and the head of the nut include tool access surfaces for engagement by tools to permit manual rotation of the head and headed end to (a) adjust the clamping forces exerted between the head and headed end, and (b) permit selective rotation of the headed end to pivot the lift about the first axis.

6. A quick release ice skate blade assembly, as claimed by claim 1 wherein the lift includes:

an elongated lever pivotably mounted to the frame for pivotal movement about a first axis transverse to the longitudinal blade receiving recess a link pivotably mounted at an upper end and extending to a lower end, the link being mounted to the other end of the lever for pivotal movement thereon about a second axis substantially parallel to the first axis;

a ball at the lower end of the link; and a complimentary recess formed in the skate blade for releasably receiving the ball and for permitting pivotal motion of the link relative to the skate blade about a third axis substantially parallel to the first axis.

7. A quick release ice skate blade assembly, as claimed by claim 1 wherein the lift includes:

an elongated lever pivotably mounted to the frame for pivotal movement about a first axis transverse to the longitudinal blade receiving recess;

a link pivotably mounted at an upper end and extending to a lower end, the link being mounted to the other end of the lever for pivotal movement thereon about a second axis substantially parallel to the first axis;

a ball at the lower end of the link;

a complimentary recess formed in the skate blade for releasably receiving the ball and for permitting pivotal motion of the link relative to the skate blade about a third axis substantially parallel to the first axis; and wherein the lock is comprised of a pivot bolt mounting the one end of the elongated lever to the frame.

8. A quick release ice skate blade assembly, comprising:

an elongated skate frame including a longitudinal blade receiving recess formed by laterally spaced flanges extending downwardly from a frame bearing surface;

an elongated skate blade including a longitudinal lower runner edge and an upper blade bearing surface;

a lift mounted within the skate frame releasably interconnecting the blade and skate frame for raising and lowering the blade elevationally between (a) a downward position wherein the upper blade bearing surface is spaced downwardly from the frame bearing surface with the skate blade being releasable from the skate frame, and (b) an upward position with the upper blade bearing surface received between the flanges and in bearing engagement with the frame bearing surface;

wherein the lift includes an elongated lever extending between ends with one end being pivotably mounted to the frame for pivotal movement about a first axis transverse to the longitudinal blade receiving recess;

a lock on the skate frame releasably securing the lift in the upward position; and wherein the lock is comprised of a pivot bolt clamp assembly mounting the one end of the elongated lever to the frame.

* * * * *